United States Patent [19]

Tanaka et al.

[11] Patent Number: 4,558,723

[45] Date of Patent: Dec. 17, 1985

[54] SENSOR FOR CONTROLLING THE SUPPLY OF WEFT YARN OR THE LIKE

[75] Inventors: Shigenori Tanaka, Hachioji; Kouji Tomita, Tama, both of Japan

[73] Assignee: Nissan Motor Co., Ltd., Yokohama City, Japan

[21] Appl. No.: 560,376

[22] Filed: Dec. 12, 1983

[30] Foreign Application Priority Data

Dec. 13, 1982 [JP] Japan ..... 57-217054

[51] Int. Cl.[4] ..... D03D 47/34; D03D 51/34

[52] U.S. Cl. ..... 139/452; 139/370.2; 242/47.01

[58] Field of Search ..... 139/452, 370.2; 242/47.01, 47.12; 66/132

[56] References Cited

U.S. PATENT DOCUMENTS 4,228,828 10/1980 Loepfe et al. ..... 139/370.2
4,381,803 5/1983 Weidmann et al. ..... 139/370.2
4,407,336 10/1983 Steiner ..... 139/452
4,471,817 9/1984 Brouwer et al. ..... 139/452 X

FOREIGN PATENT DOCUMENTS 57-29640 2/1982 Japan .
WO83/04056 11/1983 PCT Int'l Appl. ..... 139/452

OTHER PUBLICATIONS

Brochure of Skan-A-Matic Corp.-Skan-Coax Fiber Optic Skanner S322-3 Series-pp. 12 and 13.

*Primary Examiner*—James Kee Chi
*Attorney, Agent, or Firm*—Schwartz, Jeffery, Schwaab, Mack, Blumenthal & Evans

[57] ABSTRACT

A sensor which measures the amount of thread (weft yarn) drawn off a temporary storage drum and fed to a device which picks same into a shed of warp yarns, utilizes the spiralling motion of the thread as it is drawn axially off the drum, to induce the thread to move around in close proximity of the periphery of a guide aperture once for each loop of thread drawn off the drum and cut or reflect a light beam produced at or near the periphery of the aperture.

11 Claims, 6 Drawing Figures

SENSOR FOR CONTROLLING THE SUPPLY OF WEFT YARN OR THE LIKE

BACKGROUND OF THE INVENTION

1. Field of the Invention

The present invention relates generally to a sensor and more specifically to a sensor for measuring the length of filament, thread or the like drawn from a storage device.

2. Description of the Prior Art

A previously proposed sensor arrangement for a weaving loom is shown in FIG. 1 of the drawings. In this arrangement weft yarn y is wound onto a drum 2 by a winding arrangement 3 and retained thereon by a retaining device 4. During picking the retaining device 4 is actuated to retract a blocking member 5 from a recess 6 formed in the drum 2 and permit a number of loops of weft yarn y to be drawn axially off the drum.

The amount of yarn y stored on the drum is controlled by a first sensor 7 which directs a beam of light against the drum and which, in response to the amount of light reflected therefrom, induces suitable energization of the winding arrangement 3 in a manner to maintain a predetermined length of yarn on the drum. The amount of yarn permitted to be released from the drum 2 during each picking operation is controlled by a second sensor 8, which, like the first, directs a beam of light against the drum 2 in a manner that the passage of weft yarn y across the point where the beam impinges on the drum 2, induces a change in the amount of light reflected and thus the output of the light receiving section of the second sensor 8. A control unit 9 is responsive to the output of the second sensor 8 and controls the operation of the retaining device 4.

However, the latter mentioned sensor arrangement has suffered from the drawback that when applied to high speed weaving machines wherein weft yarns having a diameter ranging from tens of microns to hundreds of microns, are exposed to the beam of light for only a few micro seconds, accurate detection of each loop being drawn off the drum becomes extremely difficult. Non-detection of one of more loops of weft yarn y being drawn off the storage drum 4 of course invites an inevitable malfuction of the loom.

A full description of the above mentioned arrangement may be found in Japanese Patent Application first publication No. Sho 57-29640 or corresponding U.S. Pat. No. 4,407,336 issued in the name of Steiner on Oct. 4, 1983.

SUMMARY OF THE INVENTION

It is an object of the present invention to provide a sensor arrangement via which the amount of thread such as weft yarn extracted from a storage device may be accurately detected and which advantageously but not necessarily, finds utility in high speed weaving looms.

In brief, the present invention features a sensor wherein the spiralling motion induced in a thread as it is drawn axially off a temporary storage drum is utilized to cause the thread to move around a relatively small guide aperture on or in close proximity of the periphery thereof, once per loop of thread drawn off the drum, whereby a beam of light produced at or near the periphery of the aperture is, without fail, cut or reflected by the relatively slow moving thread.

More specifically, a first aspect of the present invention comes in the form of a sensor arrangement for sensing the amount of thread being supplied from a source thereof to an apparatus which uses same, comprising, a guide in which an aperture is formed and through which the thread passes from the source to the apparatus, means for inducing a spiralling motion in the thread prior entering the aperture in a manner that the thread moves around the aperture, and a sensor responsive to the movement of the thread in the aperture and which produces a signal indicative thereof.

A further aspect of the present invention comes in the form of a device which includes a source of thread, a storage member onto which thread from the source is wound for temporary storage prior use, an apparatus which uses the thread, a guide interposed between storage member and the apparatus, the guide having an aperture through which the thread passes from the member to the apparatus, and a sensor associated with the guide for sensing the amount of thread which passes through the aperture.

Yet another aspect of the invention comes in a weaving loom which includes therein a source of weft yarn, a temporary storage drum having an axis and onto which a length of the weft yarn may be wound to form a plurality of loops, a device for picking at least a portion of the length of weft yarn stored on the drum into a shed of warp yarn, a guide disposed between the picking device and the drum for guiding the weft yarn as it is drawn axially off the drum, the guide having an aperture the center of which is essentially coaxial with the drum, and a sensor mounted on the guide, the sensor being responsive to the movement of the weft yarn as it moves around the aperture under the influence of the spiralling motion induced therein due to the loops of weft yarn being drawn off the drum.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
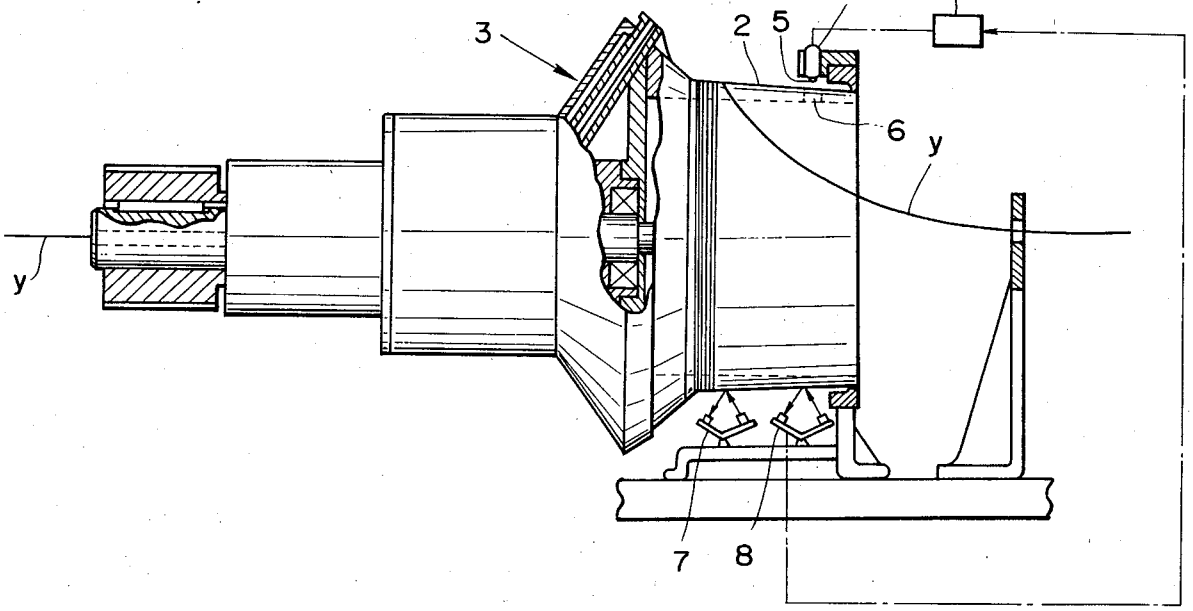
FIG.1 (PRIOR ART)
FIG. 1 shows the prior art arrangement discussed briefly in the opening paragraphs of the present invention.
Figure 2:
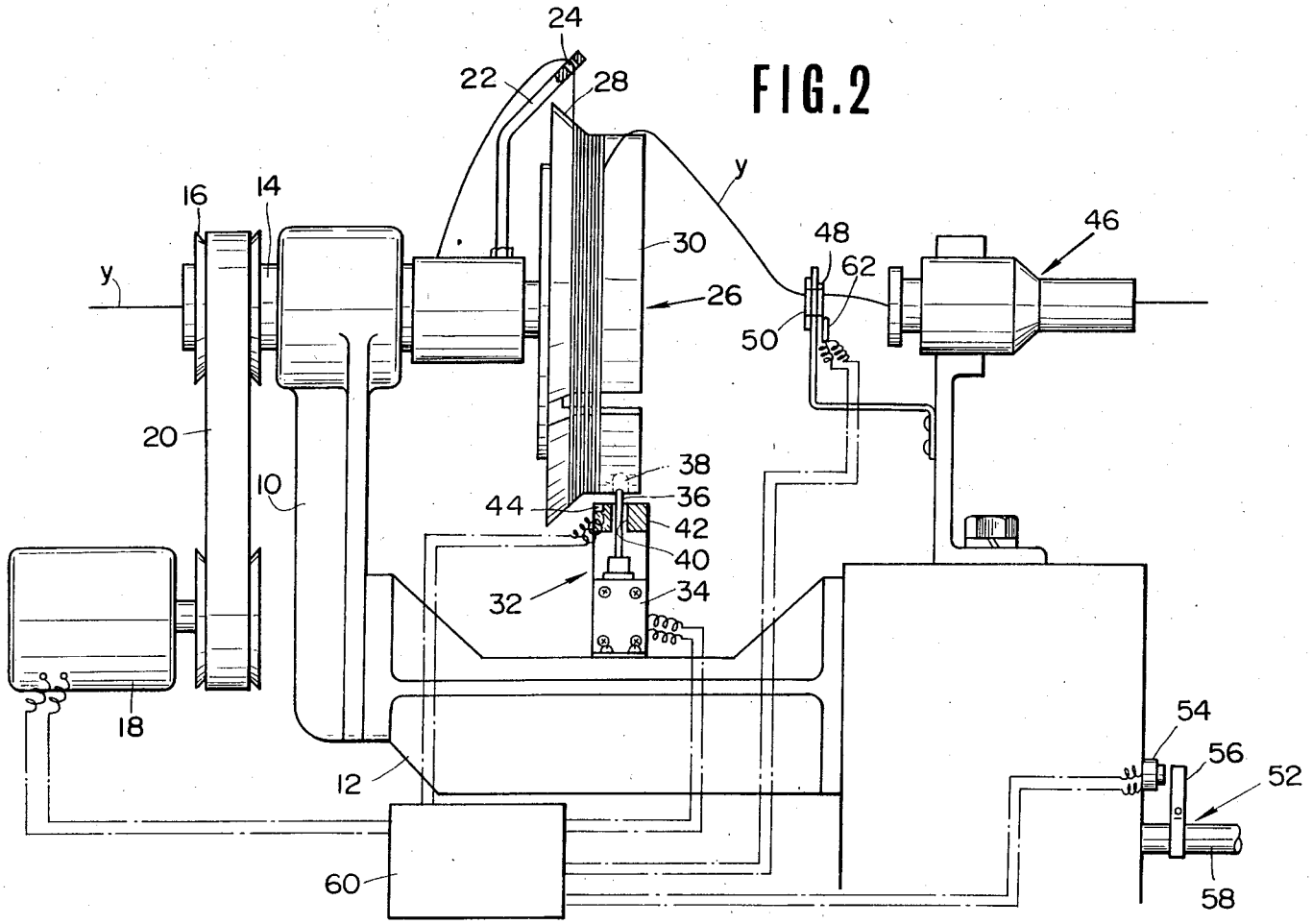
FIG. 2 is an elevational view of a weaving loom including therein a first embodiment of the present invention.

Turning now to FIG. 2 a first embodiment of the present invention is shown. In this arrangment a mounting bracket 10 forming part of a weaving loom frame 12 rotatably supports a hollow shaft 14 through which a weft yarn y is fed. One end of the shaft 14 is provided with a pulley 16 which is operatively connected with an electric motor 18 by a V-belt (or the like) 20. The other end of the shaft 14 is provided with an arm 22. This arm, as shown, is provided with an aperture 24 near the free end thereof through which the weft yarn y is threaded. It will be noted that the shaft 14 is provided with suitable apertures or through holes (not shown for simplicity of illustration) through which the weft yarn may be fed to the arm.

A temporary storage drum 26 is rotatably mounted on the end of the shaft 14 through suitable roller bearings or the like. This drum is held stationary by weights or magnets (not shown) and further constructed of three of more segments which permit the diameter thereof to be varied. The reason for this will become apparent hereinlater. The drum is also formed with a tapered or frusto-conical section 28 which is arranged with respect to the arm so that upon energization of the motor 18 the arm 22 rotates about the drum 26 to wind loops of weft yarn thereonto. The frusto-conical section 28 serves to induce the newly wound on weft yarn loops to slide along the drum toward a uniform diameter section 30 thereof during operation of the loom.

Located adjacent the periphery of the drum is a retaining device generally denoted by the numeral 32. As shown, this device includes an actuator 34 and a plunger 36 which is normally projects into a recess 38 formed in the uniform diameter section 30 of the drum, and thus prevents any of the loops of yarn y wound of the drum 26 from being removed therefrom. The plunger 36 is arranged to project through an aperture 40 formed in a cover 42 on which a weft yarn sensor 44 is mounted. Upon energization of the actuator 34 the plunger 36 is retracted into the aperture formed in the cover 42.

In this embodiment the weft yarn sensor 44 is arranged to emit a beam of light which impinges on the uniform diameter section 30 of drum and which senses the presence of a predetermined amount of the weft yarn y stored thereon via either one of (a) using a drum having a highly reflective surface and detecting the reduction in reflection caused by the loops of weft yarn, or (b) using a non-reflective drum and sensing the increase in reflection induced by the weft yarns intercepting and reflecting the beam. The selection of the above mentioned alternatives, of course, is made in view of the colour and texture of the yarn being used in the loom.

A picking device generally denoted by the numeral 46 is mounted on the frame 12 in a manner essentially coaxial with the shaft 14 and drum 26. Interposed between the picking device 46 and the drum 26 is a guide 48. This guide is formed with an aperture 50 the center of which is essentially coaxial with the drum.

Figure 3:
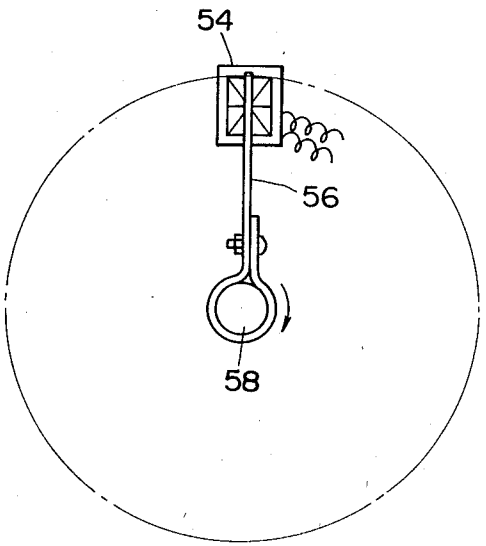
FIG. 3 is a front elevation of a proximity switch arrangement froming part of the loom shown in FIG. 2.

A proximity switch arrangement 52 is mounted on the loom frame. This switch (shown in greater detail in FIG. 3) comprises a stationary member 54 which includes a "Hall effect" switch or the like, and a movable element 56 fixed on a main shaft 58 of the loom. The movable member 56 is arranged to pass by the stationary member 54 either at, or in a timed relation with, the picking operation of the loom. The output of this switch is fed to a control circuit 60 which also receives the output of the sensor 44.

In this embodiment a sensor 62 is mounted on the picking device side of the guide 48. This sensor includes a light emitting section and light receiving section. The construction of this sensor 62 is such that the beam produced by the light emitting portion is reflected by the weft yarn each time it moves around the aperture and passes thereover under the influence of the spiralling motion produced therein as it is drawn off the drum 26 and travels toward the guide 48. The diameter of the aperture 50 is of course notably smaller than the diameter of the drum 26 whereby the speed with which the weft yarn y interrupts the light beam produced by the light emitting portion of the sensor 62 is relatively low compared with that over the surface of the drum. Accordingly, the time for which the light beam is reflected by the yarn and received by the light receiving section of the sensor, is vastly increased over that which occurs in the prior art arrangement discussed hereinbefore and accordingly enables accurate detection of each loop of yarn drawn off the drum. The output of the sensor 62 is applied to the control circuit 60.

By varying the diameter of the drum 26, the length of weft yarn y contained in a given number of loops may be readily calculated and thus adjustment made for a given width of cloth being woven in the loom.

The operation of the first embodiment is such that during each picking operation the control circuit 60 in response to the output of the proximity switch 52 energizes the actuator 34 to withdraw the plunger 36 and permit a number of weft yarn loops to be drawn off. Upon the sensor 62 indicating a preselected number of loops having been drawn off and fed to the picking device 46 through the guide 48, the control circuit 60 de-energizes the actuator and terminates the picking operation. Simultanously, upon the sensor 44 detecting the number of loops wound on the drum 26 ready for picking having fallen blow a preselected number, the control circuit 60 energizes the motor 18 to wind on some more yarn. As will be appreciated, the loops wound on the frusto-conical portion 28 will slide therealong and onto the uniform diameter portion 30 until the light beam produced by the light emitting section of the sensor 44 intercepts same.

Figure 4:
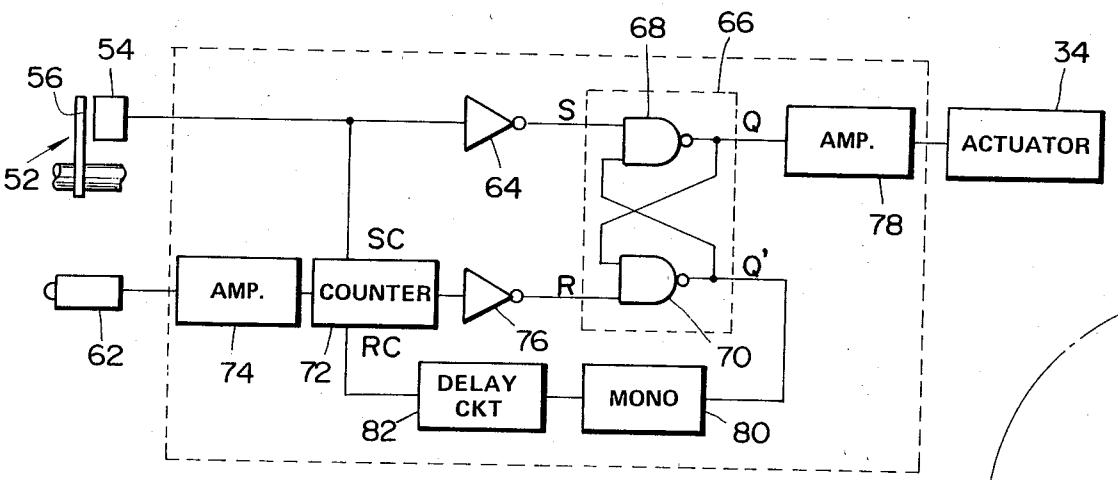
FIG. 4 is a circuit shown in block diagram form suitable for use with the first embodiment of the present invention.

FIG. 4 shows an example of circuitry which may be used in the control circuit 60. As illustrated this circuit includes a NOT circuit 64 which receives the output of the proximity switch 52 and which is connected to a S (set) terminal of a flip flop circuit 66 including two NAND circuits 68, 70 and a counter 72 which also receives the output of the proximity switch 52 at a SC (start count) terminal thereof. The output of the sensor 62 is fed to an amplifier 74 which outputs a signal to the input terminal of the counter 72. The output of the counter 72 is fed to a NOT circuit 76 connected to the R (reset) terminal of the flip flop 66. A "Q" terminal of the flip flop 66 is connected via an amplifier 78 to the actuator 34 of the retaining device 32. A "Q'" terminal of the flip flop 66 is connected through a monostable multivibrator or "ONE SHOT" circuit 80 to a delay circuit 82 connected to the RC (reset count) terminal of the counter 72. With this arrangement, upon a signal being applied to the SC terminal of the counter 72, the counter begins counting. Upon a predetermined number being reached the counter outputs a signal which resets the flip flop 66 and the counter 72 (with a give delay).

Figure 5:
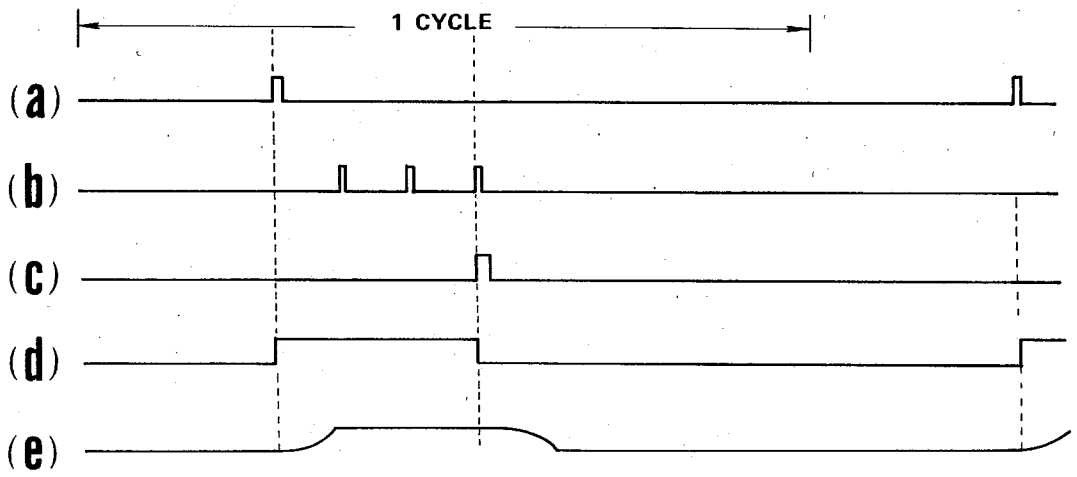
FIG. 5 is a timning chart showing the signals inputted to and outputted by the various elements shown in the circuit arrangement of FIG. 4.

FIG. 5 shows in time chart form the operation of the above described circuit. As shown, upon the proximity switch outputting a pulse (see chart 5(*a*)) indicative of the initiation of a picking operation the flip flop 66 is set to produce a high level signal on its Q output as shown in chart 5(*d*). Accordingly, the actuator 34 is energized and extracts the plunger 36 as shown in chart 5(*e*). Upon the plunger 36 having been drawn out of the recess 38, the weft yarn y is drawn off the drum 26 by the picking device 46 the operation of which is initiated at the same time as the proximity switch 52 produces the aforementioned pulse. Upon the counter 72 having counted up to the predetermined number (for example 3) the flip flop 66 is reset by the output of counter 72 shown in chart 5(*c*) and the signal appearing on the "Q" output thereof assumes a low level (see chart 5*d*). The plunger 36 is accordingly permitted to move toward and re-enter the recess 38 (as shown) whereupon the picking operation is terminated. Upon the Q output falling to a low level, a high level signal appears on the Q' output of the flip flop 66 which triggers the monostable multivibrator 80 to output a high level signal for a predetermined duration which is transmitted (with a predetermined delay) via the delay circuit 82 to the RC terminal of the counter 72. The counter is therefore reset ready for the next picking operation.

Figure 6:
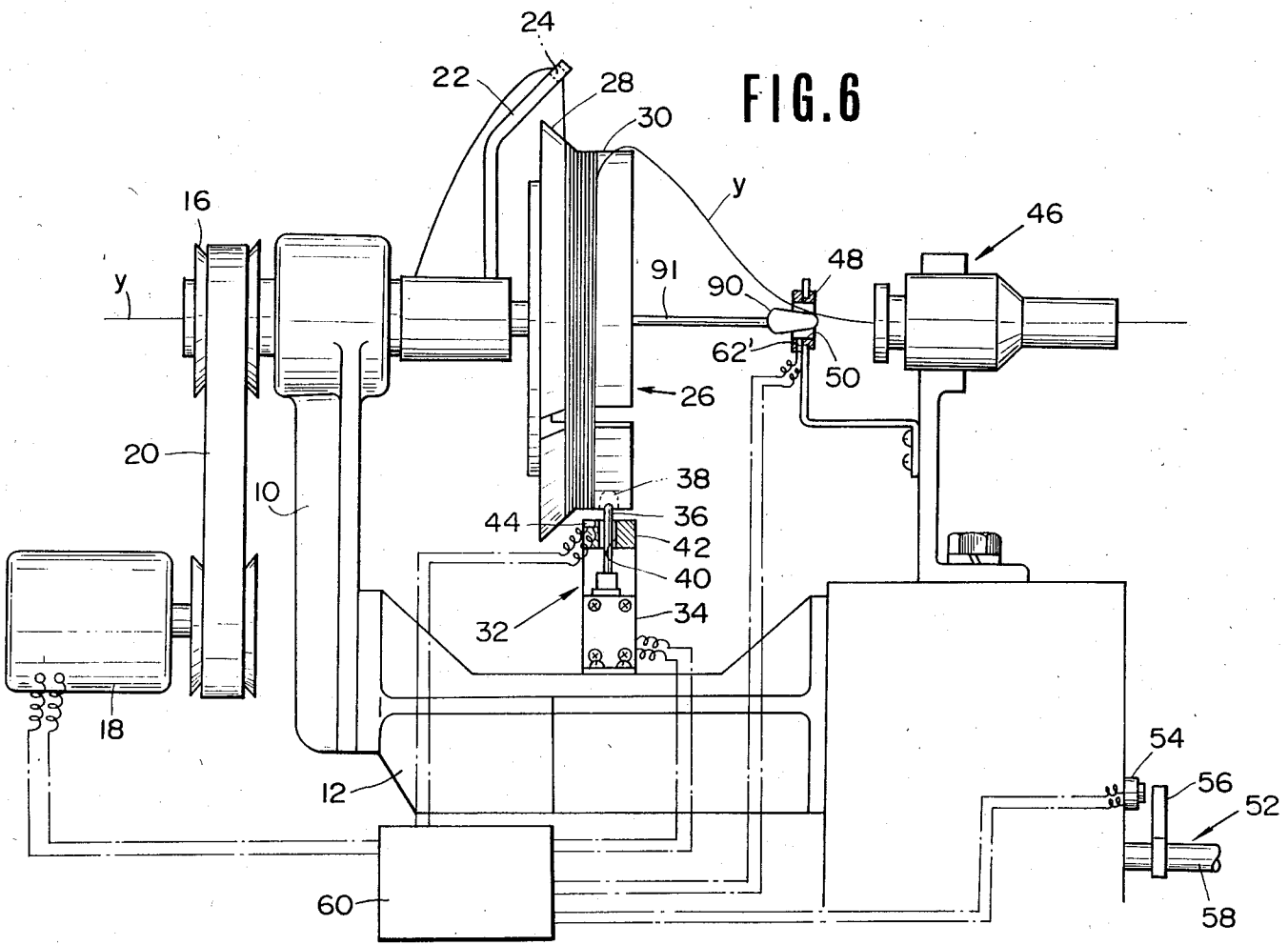
FIG. 6 is an elevation similar to that of FIG. 2 but which shows a second embodiment of the present invention.

FIG. 6 shows a second embodiment of the present invention. This arangement is essentially identical with the first except for the provision of a probelike projection 90 mounted on shaft 91 extending from the drum 26. The projection 90 is arranged to extend into the aperture 50 and deflect the weft yarn toward the periphery of the aperture 50 as it passes through the guide 48 toward the picking device 46. This maintains the yarn within a predetermined distance of the periphery and hence the sensor 62', which in this embodiment is disposed in the guide per se. This arrangement unfailingly maintains the weft yarn y within a predetermined distance of the light emitting and receiving portions of the sensor 62' and therefore eliminates any possibility of the weft yarn y passing by the sensor undetected. The projection 90 is arranged to be non-reflective (viz., have a dark colour and mat finish) to avoid any undesired reflections occuring.

A device suitable for use as the sensors 62, 62' and 44 utilized in the above described embodiments is commercially available from the SKAN-A-MATIC corporation under the trade name of SKAN-COAX FIBER OPTIC SKANNER S322-3 SERIES.

What is claimed is:

1. A sensor arrangement for sensing the amount of thread being supplied from a source thereof to an apparatus which uses same, comprising;

a guide in which an aperture is formed and through which said thread passes from said source to said apparatus;

means for inducing a spiralling motion in said thread prior to entering said aperture and in a manner such that said thread slides in a predetermined direction around an inner periphery of said aperture; and a sensor which detects said thread passing by a preselected point on said inner periphery and which outputs a signal each time said thread passes by said point.

2. In a device:

a source of thread;

a storage member into which thread from said source is wound for temporary storage prior use;

an apparatus which uses said thread;

a guide interposed between said storage member and said apparatus, said guide having an aperture through which said thread passes from said storage member to said apparatus;

a sensor associated with said guide for sensing the amount of thread which passes through said aperture; and means for releasing thread from said storage member, said means being responsive to said sensor for terminating the release of thread from said storage member upon said sensor sensing that a predetermined amount of thread has passed therethrough.

3. A device as claimed in claim 2, wherein said storage member takes the form of a drum having an axis and wherein said aperture is located so that the center thereof is essentially located on said axis.

4. A device as claimed in claim 3, wherein said sensor is arranged to sense the movement of said thread around said aperture which movement is induced by the loops of thread being drawn axially off said drum.

5. In a weaving loom a source of weft yarn;

a temporary storage drum onto which a length of said weft yarn may be wound to form a plurality of loops, said drum having an axis;

a device for picking at least a portion of the length of weft yarn stored on said drum into a shed of warp yarn;

a guide disposed between said picking device and said drum for guiding said weft yarn as it is drawn axially off said drum, said guide having an aperture the center of which is essentially coaxial with said drum; and a sensor mounted in close proximity to said guide, said sensor being responsive to the movement of said weft yarn as it moves around said aperture under the influence of the spiralling motion induced therein due to the loops of weft yarn being drawn off said drum and arranged to output a signal each time a loop of thread is drawn off said temporary storage drum.

6. A weaving loom as claimed in claim 5, wherein said sensor includes means for producing a beam of light and means for detecting said beam of light when it is reflected by said weft yarn.

7. A weaving loom as claimed in claim 5, further comprising a projection disposed in said aperture in a manner to deflect said weft yarn toward the inner periphery of said aperture.

8. A weaving loom as claimed in claim 5, further comprising:

a switch responsive to the cyclic operation of said loom and which produces a signal indicative of a picking;

a retaining device for normally preventing said weft yarn from being drawn off said drum; and a circuit operatively interconnecting said retaining device with said sensor and said switch, said circuit being arranged to control said retaining device in response to the outputs of said sensor and said switch in a manner to permit a predetermined number of loops of weft yarn to be drawn off said drum during each picking operation.

9. A weaving loom as claimed in claim 5, wherein said drum has a variable diameter to permit the adjustment of the length of each loop of weft yarn stored on said drum.

10. A weaving loom as claimed in claim 5, further comprising means for sensing the amount of weft yarn stored on said drum and for winding loops of weft yarn onto said drum in the event that the amount of weft yarn is sensed below a predetermined level.

11. A sensor arrangement as claimed in claim 1 further comprising means for terminating the release of thread from said source upon a predetermined number of signals being produced by said sensor.

* * * * *